US011235544B2

(12) United States Patent
Leoni et al.

(10) Patent No.: US 11,235,544 B2
(45) Date of Patent: Feb. 1, 2022

(54) COMPACTION PRESS

(71) Applicant: IDROMEC S.P.A., Mozzecane (IT)

(72) Inventors: Paolo Leoni, Povegliano (IT); Roberto Tabarelli, Mozzecane (IT)

(73) Assignee: IDROMEC S.P.A., Mozzecane (IT)

( * ) Notice: Subject to any disclaimer, the term of this patent is extended or adjusted under 35 U.S.C. 154(b) by 85 days.

(21) Appl. No.: 16/871,076

(22) Filed: May 11, 2020

(65) Prior Publication Data

US 2021/0347137 A1 Nov. 11, 2021

(51) Int. Cl.

| | |
|---|---|
| ***B30B 9/32*** | (2006.01) |
| ***B30B 9/30*** | (2006.01) |
| ***B30B 15/06*** | (2006.01) |
| ***B30B 15/04*** | (2006.01) |
| *B30B 15/30* | (2006.01) |

(52) U.S. Cl.

CPC ..... *B30B 9/32* (2013.01); *B30B 9/3021* (2013.01); *B30B 9/3078* (2013.01); *B30B 9/3082* (2013.01); *B30B 15/041* (2013.01); *B30B 15/062* (2013.01); *B30B 15/068* (2013.01); *B30B 15/30* (2013.01); *Y10S 100/901* (2013.01)

(58) Field of Classification Search

CPC .. B30B 7/04; B30B 9/32; B30B 9/301; B30B 9/3021; B30B 9/3078; B30B 9/3082; B30B 9/3007; B30B 15/041; B30B 15/062; B30B 15/30; B30B 15/068; Y10S 100/901

See application file for complete search history.

(56) References Cited

U.S. PATENT DOCUMENTS

| | | | | |
|---|---|---|---|---|
| 2,932,247 | A * | 4/1960 | Thompson | B30B 9/326 100/232 |
| 4,120,243 | A * | 10/1978 | Kaplan | B30B 9/3082 100/212 |
| 5,445,331 | A * | 8/1995 | Berhaut-Streel | B02C 18/02 241/79.1 |
| 2009/0056564 | A1* | 3/2009 | van der Beek | B23D 31/04 100/95 |
| 2019/0322063 | A1* | 10/2019 | Rosser, Jr. | B30B 9/3078 |

FOREIGN PATENT DOCUMENTS

| | | |
|---|---|---|
| IT | 1206444 B | 4/1989 |

* cited by examiner

*Primary Examiner* — Jimmy T Nguyen
(74) *Attorney, Agent, or Firm* — Mark M. Friedman

(57) ABSTRACT

Compaction press includes a support structure provided with an abutment surface; a first compaction lid, which is provided with a first flat compaction surface and is rotatably constrained to a first delimitation edge of the support structure; a second compaction lid, which is provided with a second curved compaction surface and is rotatably constrained to a second delimitation edge of the support structure. The abutment surface of the support structure and the first and second compaction surfaces of the first and second compaction arms delimit a pressing chamber, in which a mass of material to be compacted is intended to be deposited. In addition, the second compaction lid includes a first arm and a second arm which are rotatably constrained to each other.

15 Claims, 10 Drawing Sheets

COMPACTION PRESS

FIELD OF APPLICATION

The present invention regards a compaction press.

The present compaction press is inserted in the industrial field of heavy machines for compacting solid materials, such as in particular scrap (for example ferrous and non-ferrous scrap comprising parts of automobiles, bicycles, beams, etc.), solid waste, etc.

In particular, the present compaction press is provided with two compaction lids that can be moved in order to compress the material to be compacted into a limited volume pack.

STATE OF THE ART

As is known, presses are diffused on the market for compacting a loose mass of voluminous scrap, in particular ferrous scrap, into a compact mass so as to be able to easily forward it to subsequent recycling and/or melting steps.

The compaction presses of known type conventionally comprise a support structure provided with an abutment surface for the loose mass of scrap and two compaction lids hinged to the support structure and adapted to be moved between a completely open configuration, in order to allow the loading of the loose mass of scrap on the abutment surface, and a completely closed configuration, in order to press the loose mass of scrap against the abutment surface so as to obtain a compact mass with polyhedral shape, and in particular parallelepiped shape with substantially square or rectangular base.

For example, the patent IT1206444 describes a compaction press of known type provided with a support structure having an abutment surface with substantially L-shaped form provided with a horizontal (base) face and with a vertical (lateral) face. At the free ends of the abutment surface, a first and a second compaction lid are hinged.

More in detail, the first compaction lid, hinged to the vertical face of the abutment surface, is provided with a first flat compaction surface and the second compaction lid, hinged to the horizontal face of the abutment surface, is provided with a second compaction surface that is at least partially curved.

In addition, the compaction press of known type described in IT1206444 is provided with a movement system (e.g. comprising multiple hydraulic cylinders) adapted to move the two compaction lids between a completely open configuration and a completely closed configuration.

More in detail, when the press is in the completely open configuration, the first compaction lid is placed in substantially vertical position and the second compaction lid is placed in substantially horizontal position, with the first and the second compaction surface respectively substantially aligned with the vertical and horizontal faces of the abutment surface, in a manner such to allow the loading of the loose mass of scrap. When it is in the completely closed configuration, the first compaction lid is substantially horizontal and the second compaction lid is substantially vertical, with the first and the second compaction surfaces respectively substantially orthogonal to the vertical and horizontal faces of the abutment surface, in a manner such to delimit a closed chamber in which the scrap mass is compressed.

Advantageously, the curved shape of the second compaction surface of the second compaction lid allows the latter to push the loose mass of scrap towards the abutment surface of the support structure, facilitating the compaction of loose masses of scrap in which also projecting elements are present without part of such scrap remaining outside the compact mass.

The press of known type briefly described up to now is susceptible of optimizations regarding several operating factors, such as in particular the distribution of scrap in the compact mass and the stresses to which the compaction lids are subjected during the work operations.

PRESENTATION OF THE FINDING

The main object of the present finding is therefore to overcome the drawbacks manifested by the solutions of known type, by providing a compaction press capable of obtaining a uniform distribution of the material in the compact mass, optimizing the volume of the latter.

A further object of the present finding is to provide a compaction press capable of operating by exerting limited stresses on the first compaction lid.

A further object of the present finding is to provide a compaction press provided with an ample freedom of maneuvering on its compaction lids and capable of compacting loose masses of scrap that are even quite voluminous.

Another object of the present finding is to provide a compaction press that is entirely efficient and reliable in operation.

BRIEF DESCRIPTION OF THE DRAWINGS

The technical characteristics of the invention, according to the aforesaid objects, and the advantages thereof will be more evident from the following detailed description, made with reference to the enclosed drawings, which represent a merely exemplifying and non-limiting embodiment of the invention in which.

DETAILED DESCRIPTION OF A PREFERRED EMBODIMENT

Figure 1:
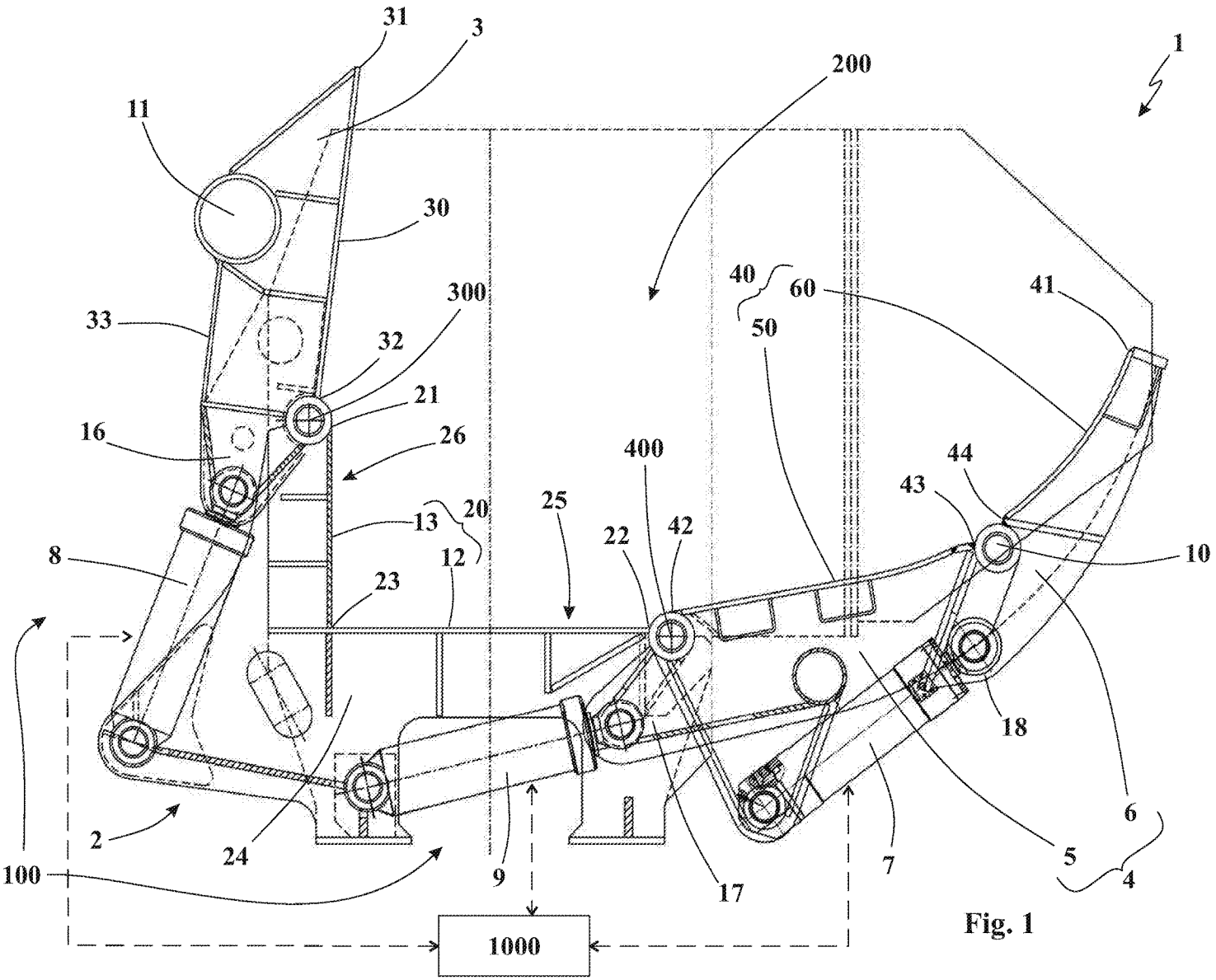
FIG. 1 shows a side view of the compaction press, object of the present invention, with the two compaction lids in open position.

With reference to the enclosed drawings, reference number 1 overall indicates a compaction press, object of the present finding.

The present compaction press 1 is intended to be advantageously employed for compacting a mass of solid materials, in particular loose, composed for example of metal and non-metal scrap, such as parts of cars, bicycles, beams, etc.

in a manner such to compress such mass in compact blocks, e.g. with parallelepiped shape.

According to the finding the compaction press 1 comprises a support structure 2, provided with at least one abutment surface 20 extended between a first delimitation edge 21 and a second delimitation edge 22.

Advantageously, the abutment surface 20 of the support structure 2 defines a housing concavity adapted to house the mass of scrap.

Preferably, as indicated in the enclosed figures, the abutment surface 20 of the support structure 2 substantially has L-shaped form and comprises a base face 12, substantially horizontal, extended between the second delimitation edge 22 and a vertex edge 23, and a lateral face 13, substantially orthogonal to the base face 12 (in particular substantially vertical) and extended between the first delimitation edge 21 and the vertex edge 23.

Preferably, in accordance with the embodiments illustrated in the enclosed figures, the support structure 2 comprises a support frame 24 provided with an abutment wall 25 (in particular substantially horizontal) defining the aforesaid base face 12, and with a lateral wall 26 (in particular substantially vertical) integral with the abutment wall 25 and defining the aforesaid lateral face 13.

Advantageously, the support structure 2 is intended to be installed on the ground (e.g. at a demolition plant) or on a transport vehicle (such as a truck or a trailer) in order to be able to transport the compaction press 1 at the work site.

According to the finding, the compaction press 1 comprises a first compaction lid 3, provided with a first compaction surface 30 extended between a first external edge 31 and a first internal edge 32, at which the first compaction lid 3 is rotatably constrained to the support structure 2 at the first delimitation edge 21 of the latter.

In addition, the compaction press 1 comprises a second compaction lid 4, provided with a second compaction surface 40 with concave profile and at least partially curved and extended between a second external edge 41 and a second internal edge 42, at which the second compaction lid 4 is rotatably constrained to the support structure 2 at the second delimitation edge 22 of the latter.

Advantageously, the support structure 2, the first compaction lid 3 and the second compaction lid 4 are made of metal material and preferably of steel.

According to the finding, the abutment surface 20, the first compaction surface 30 and the second compaction surface 40 delimit a pressing chamber 200 in which the mass of material to be compacted is intended to be inserted.

Figure 2:
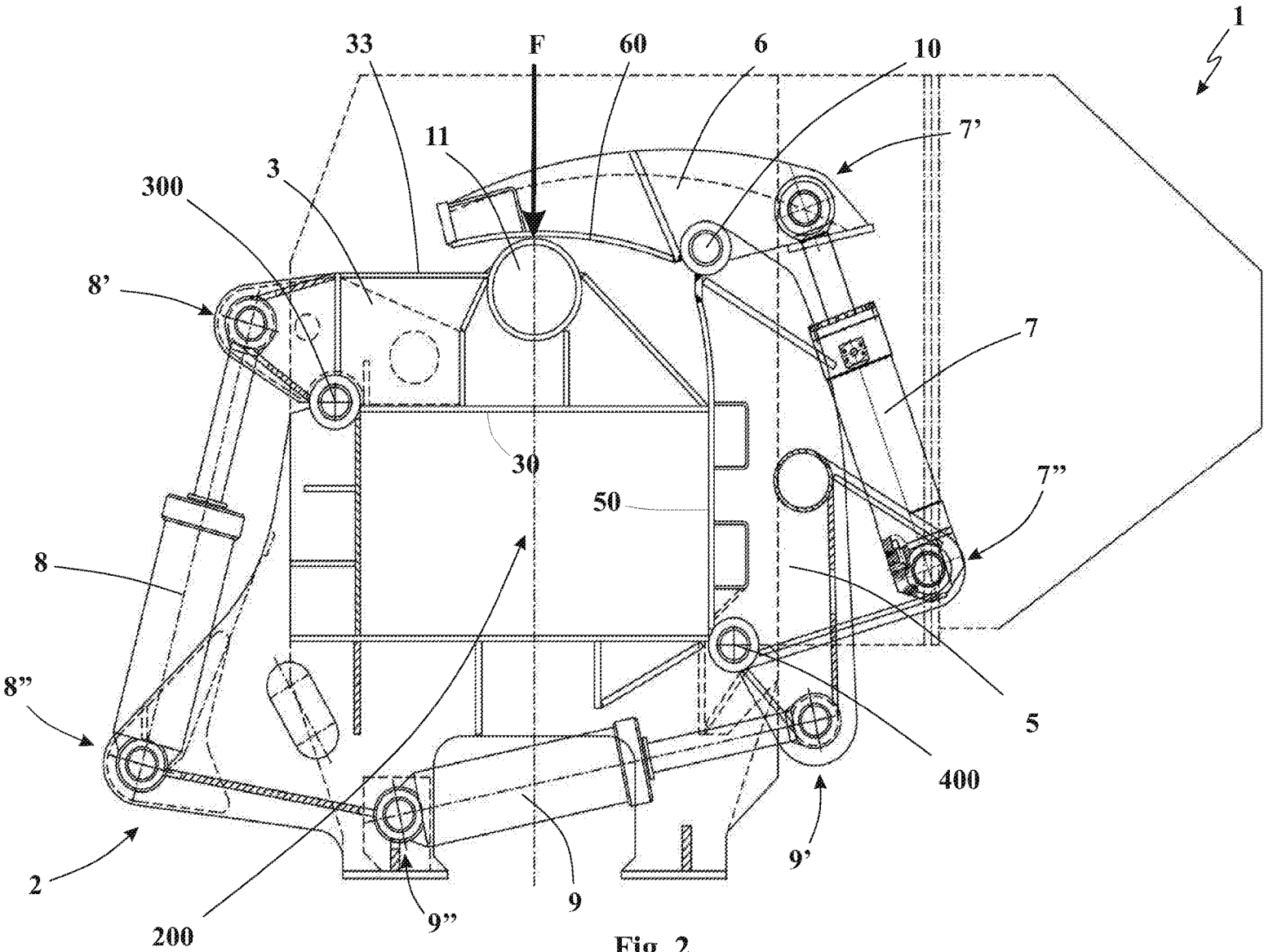
FIG. 2 shows a side view of the compaction press, object of the present invention, with the two compaction lids in closed position.

The compaction press 1 also comprises a movement system 100 mechanically connected to the first compaction lid 3 and to the second compaction lid 4 and adapted to move the aforesaid first and second compaction lids 3, 4 between an open position (as illustrated in the example of FIG. 1) in which the pressing chamber 200 is open in order to allow the depositing of the mass of material, and a closed position (as illustrated in the example of FIG. 2) in which the pressing chamber 200 is closed by the first and second compaction lids 3, 4 in order to compact the mass of material.

The second compaction lid 4 of the compaction press 1 comprises a first arm 5 defining a first section 50 of the second compaction surface 40, extended between the second internal edge 42 and a third internal edge 43, and a second arm 6 defining a second section 60 of the second compaction surface 40, extended between the second external edge 41 and a fourth internal edge 44. At such fourth internal edge 44, the second arm 6 is rotatably constrained to the first arm 5 at the third internal edge 43.

Figure 9:
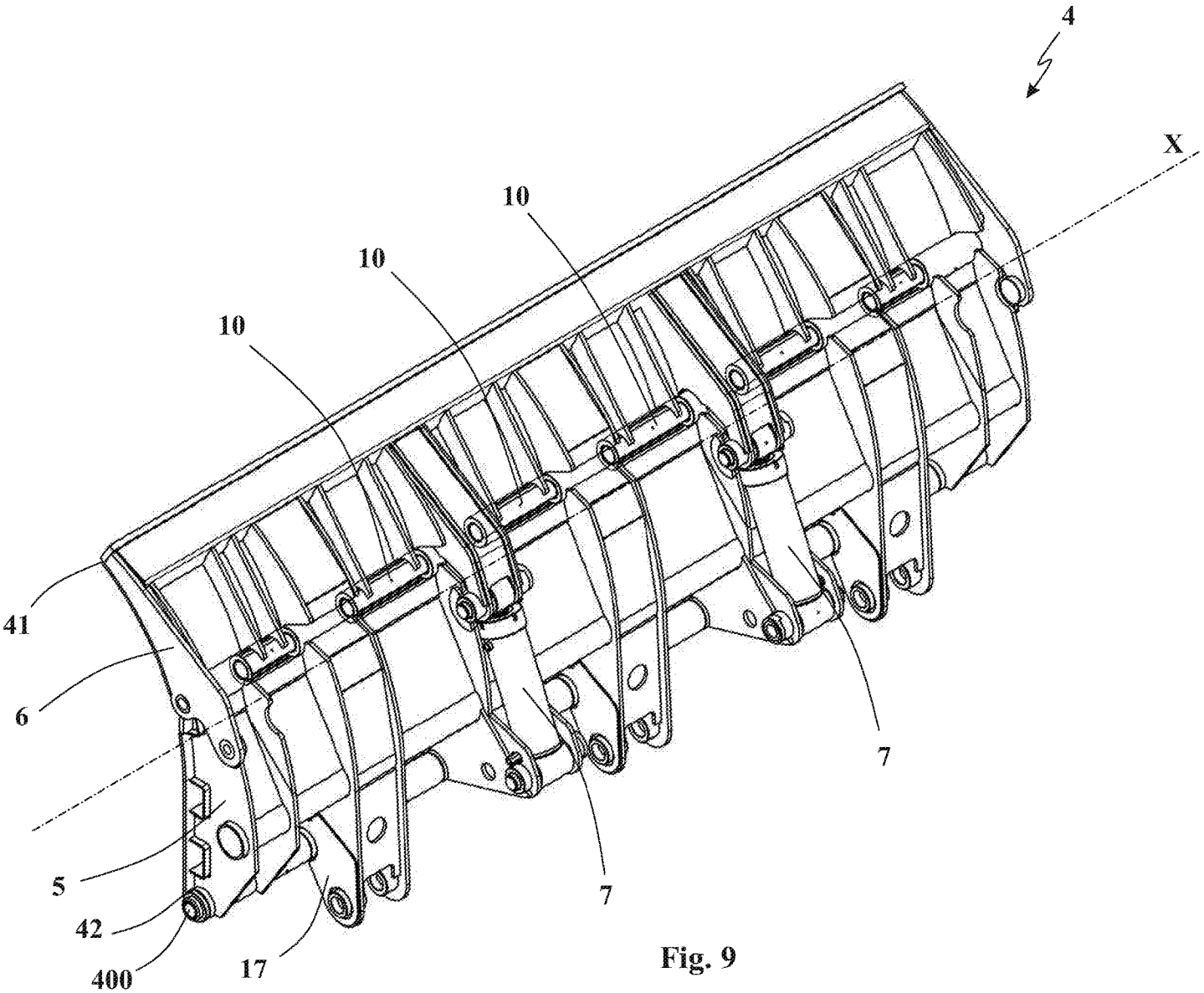
FIG. 9 shows a perspective view of the second compaction lid illustrated in FIG. 8.

Advantageously, the second pressing lid 4 is longitudinally extended along a first longitudinal axis X (indicated in the example of FIG. 9) substantially parallel to the second internal edge 42 and advantageously the first pressing lid 3 is longitudinally extended along a second longitudinal axis (not represented in the enclosed figures) substantially parallel to the first internal edge 32 and parallel to the first longitudinal axis X.

As illustrated in the examples of the enclosed figures, the first arm 5 of the second compaction lid 4 is advantageously hinged to the second arm 6 of the second compaction lid 4 by means of at least one first hinge 10 having rotation axis parallel to the first longitudinal axis X.

In addition, the first compaction lid 3 is advantageously constrained to the support structure 2 by means of a second hinge 300, which is extended along the first internal edge 32 for the entire longitudinal extension of the first compaction lid 3 and has rotation axis parallel to the second longitudinal axis.

In addition, the second compaction lid 4 is advantageously constrained to the support structure 2 by means of a third hinge 400, which is extended along the second internal edge 42 for the entire longitudinal extension of the second compaction lid 4 and has rotation axis parallel to the first longitudinal axis X.

Advantageously, the pressing chamber 200 is longitudinally extended along an axis substantially parallel to the first longitudinal axis X and to the second longitudinal axis and has a longitudinal extension substantially coinciding with the entire longitudinal extension of the support structure 2 of the compaction press 1, preferably comprised between 3 meters and 8 meters and preferably between 4 meters and 6 meters and preferably is 5 meters.

In accordance with the example of FIG. 2, the pressing chamber 200, when the compaction lids 3, 4 are in the closed position, has substantially parallelepiped shape, preferably with square or rectangular base, whose lateral surfaces are delimited by the abutment surface 20 of the support structure 2, by the first compaction surface 30 of the first compaction lid 3 and by the first section 50 of the second compaction surface 40 of the second compaction lid 4.

Advantageously, in accordance with the embodiment illustrated in the enclosed figures, the first compaction surface 30 of the first compaction lid 3 is substantially flat, is longitudinally extended along the second longitudinal axis and advantageously has a transverse section, comprised between the first internal edge 32 and the first external edge 31, comprised in particular between 50 centimeters and 120 centimeters and preferably is about 1 meter.

Advantageously, the first section 50 of the second compaction surface 40 is at least partially flat, is longitudinally extended along an axis substantially parallel to the first longitudinal axis X and advantageously has a transverse extension, comprised between the second and the third internal edges 42, 43, in particular between 50 centimeters and 1 meter and preferably of about 80 centimeters.

Advantageously, moreover, the second section 60 of the second compaction surface 40 is curved and has concavity directed towards the interior of the pressing chamber 200, is longitudinally extended along an axis substantially parallel to the first longitudinal axis X and preferably has a transverse extension, comprised between the fourth internal edge 44 and the second external edge 41, in particular comprised between 50 centimeters and 1 meter and preferably is about 80 centimeters.

In accordance with a preferred embodiment, the movement system 100 comprises at least one first actuator 8, and preferably multiple first actuators 8, each of which connected to the first compaction lid 3, preferably at a first grip portion 16 of the first compaction lid 3 made at the first internal edge 32 of the first compaction surface 30.

In particular, the first actuator 8 is of linear type and is preferably extended between a first movement end 8' hinged to the first compaction lid 3, and a first reaction end 8" hinged to the support structure 2.

In operation, each first actuator 8 is adapted to move the first compaction lid 3 between a first retreated position, in which the first compaction surface 30 is placed substantially as a continuation of the lateral face 13 of the abutment surface 20 of the support structure 2, and substantially directed in the same direction as such lateral face 13 and a first advanced position, in which the first compaction surface 30 faces the base face 12 of the abutment surface 20 of the support structure 2 and preferably is substantially parallel to such base face 12.

Advantageously, the movement system 100 comprises at least one second actuator 9, and preferably multiple second actuators 9, each of which connected to the first arm 5 of the second compaction lid 4, preferably at a second grip portion 17 of the first arm 5 of the second compaction lid 4 made at the second internal edge 42 of the first section 50 of the second compaction surface 40.

In particular, the second actuator is of linear type and is preferably extended between a second movement end 9', hinged to the first arm 5 of the second compaction lid 4, and a second reaction lid 9", hinged to the support structure 2.

In operation, each second actuator 9 is adapted to move the first arm 5 of the second compaction lid 4 between a second retreated position, in which the first section 50 of the second compaction surface 40 of the first arm 5 is placed substantially as a continuation of the base face 12 of the abutment surface 20 of the support structure 2 and directed substantially in the same direction as such base face 12, and a second advanced position, in which the first section 50 of the second compaction surface 40 faces the lateral face 13 of the abutment surface 20 of the support structure 2 preferably is substantially parallel to such lateral face 13.

The movement system 100 is mechanically connected to the second arm 6 of the second compaction lid 4 and is arranged for moving the second arm 6 with respect to the first arm 5.

Figure 4:
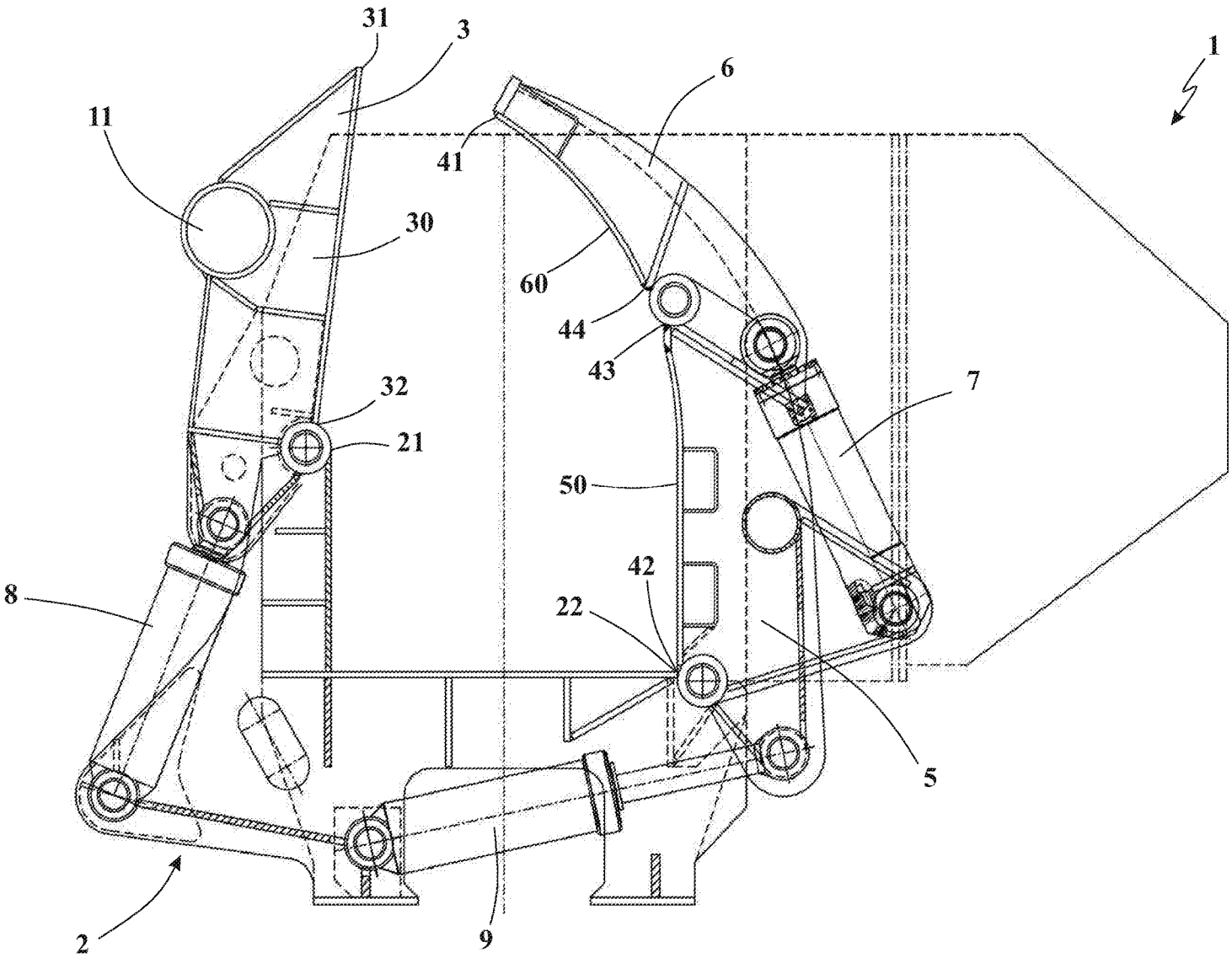
Figure 5:
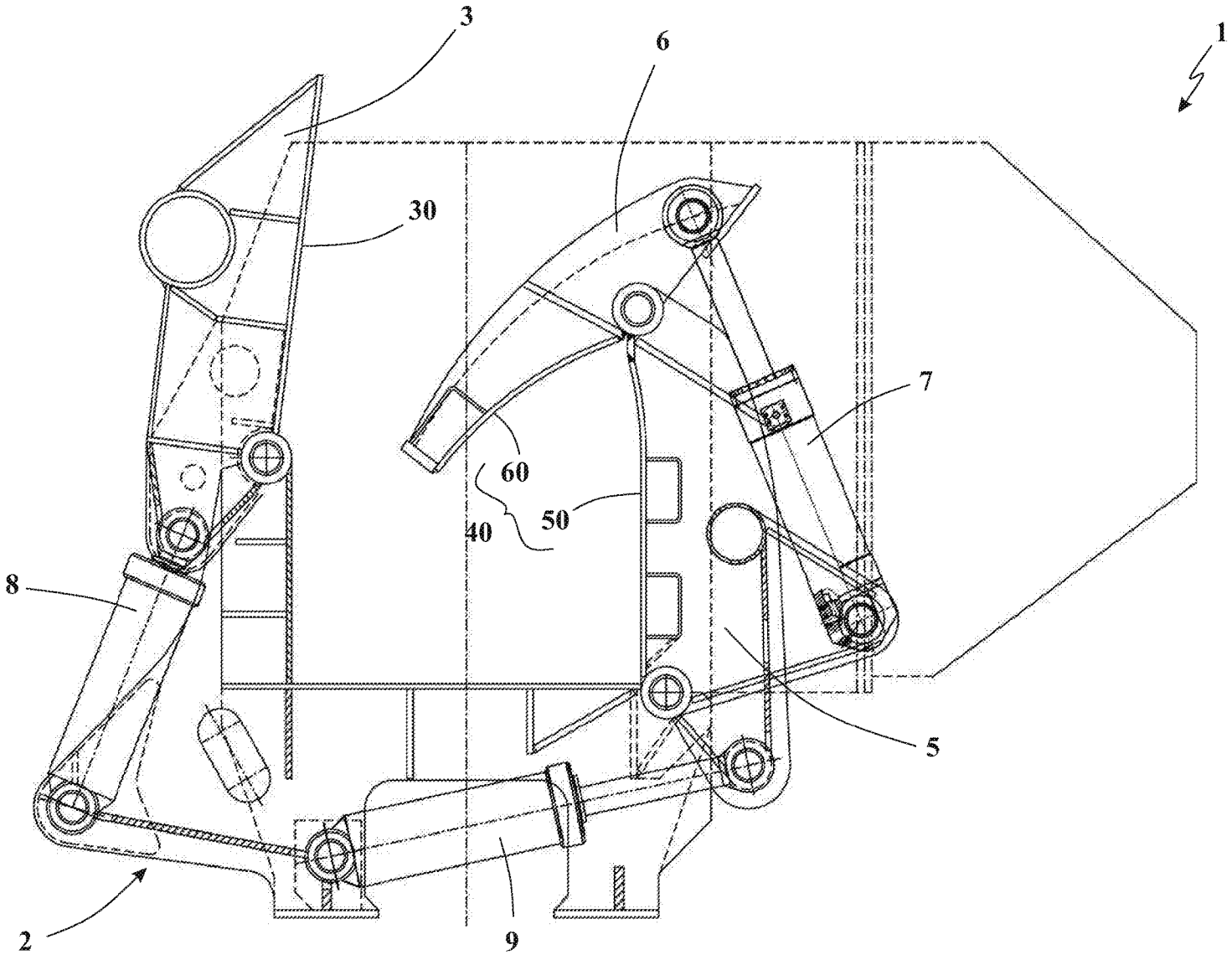

More in detail, the movement system 100 is arranged for moving the second arm 6 between an extended position (as indicated in the examples of FIGS. 1 and 4) and a collected position (as indicated in the examples of FIGS. 2 and 5) in which the second section 60 of the second compaction surface 40 faces the first section 50 of the second compaction surface 40 itself.

Advantageously, the movement system 100 comprises at least one movement actuator 7, and preferably multiple movement actuators 7, each of which mounted on the first arm 5 of the second compaction lid 4 and connected to the second arm 6, preferably at a third grip portion 18 made at the fourth internal edge 44 of the second section 60 of the second compaction surface 40.

Preferably, each movement actuator 7 is a linear actuator, and is preferably extended between a third movement end 7', hinged to the second arm 6, and a third reaction end 7" hinged to the first arm 5.

In operation, the movement actuators 7 are adapted to move the second arm 6 of the second compaction lid 4 between the extended position and the collected position.

Advantageously, each actuator 7, 8, 9 of the movement system 100 is obtained with a corresponding hydraulic cylinder.

Advantageously, the movement system 100 comprises a control unit 1000 (schematically illustrated in FIG. 1) operatively connected to the movement actuator 7, to the first actuator 8 and to the second actuator 9 and configured for independently actuating the aforesaid actuators 7, 8, 9.

Advantageously, the configuration of the present compaction press 1, with the second compaction lid 4 provided with two articulated arms 5, 6, allows obtaining a high freedom of movements, allowing the compaction of masses of waste that are even quite voluminous, since the first compaction lid 3 and the first and the second arms 5, 6 of the second compaction lid 4 are movable to act along multiple movement directions.

Indicated in the enclosed FIGS. 1-6 are, by way of example, several operating positions of the first compaction lid 3 and of the first and second arms 5, 6 of the second compaction lid 4. Such operating positions are usually several of the possible positions that the first and second compaction lid 3, 4 can assume, also in a different order than that indicated by the enclosed figures, based on the nature of the scrap mass to be compacted.

Represented in FIG. 1 is the open position of the compaction press 1, in which the first compaction lid 3 is situated in the first retreated position, the first arm 5 of the second compaction lid 4 is situated in the second retreated position and the second arm 6 is situated in the extended position. Advantageously, when the first and the second compaction lids 3, 4 are situated respectively in the first and second retreated positions, it is possible to load the scrap mass to be compacted within the pressing chamber 200.

Represented in FIG. 2 is the closed position of the compaction press 1, in which the first compaction lid 3 is situated in the first advanced position, the first arm 5 of the second compaction lid 4 is situated in the second advanced position and the second arm 6 is situated in the collected position, in abutment against an external surface 33 of the second compaction lid 3, substantially opposite the first compaction surface 30.

FIGS. 3 to 6 illustrate several examples of operating positions actuatable between the open position and the closed position, also with a different order than that of the aforesaid FIGS. 3-6.

Figure 3:
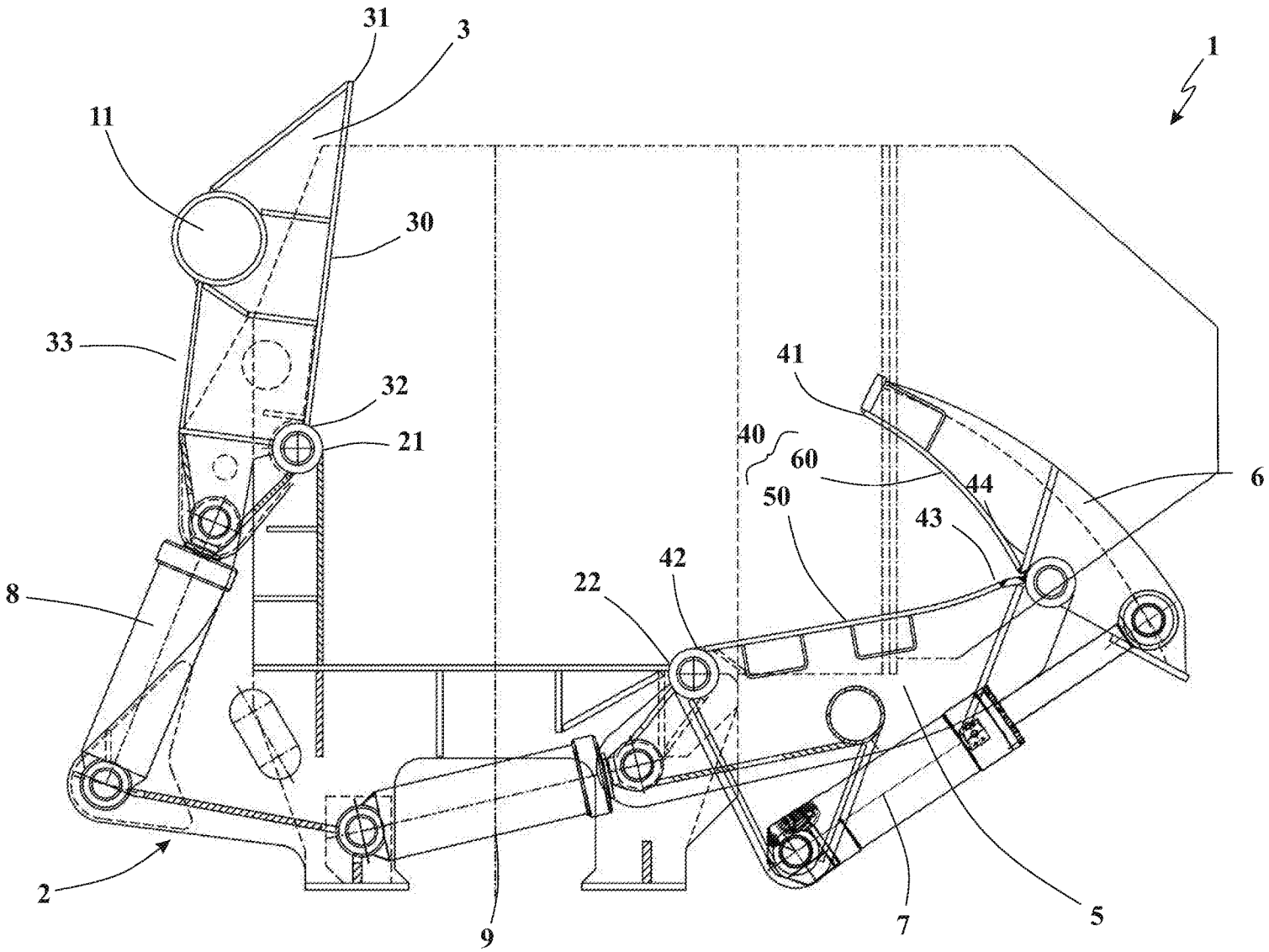
FIGS. 3-6 show corresponding side views of the compaction press, object of the present invention, with the two compaction lids in different operating positions between the open position and the closed position.

Represented in FIG. 3 is a position of pre-compaction of the compaction press 1, in which the first compaction lid 3 is situated in the first retreated position, the first arm 5 of the second compaction lid 4 is situated in the second retreated position and the second arm 6 is situated in the collected position.

Advantageously, when the second arm 6 is moved towards the collected position, it is possible to carry out a pre-compaction of the mass of material, by compacting towards the interior of the pressing chamber 200 the portion of the mass of material situated on top of the second section 60 of the second compaction surface 40 defined by the second arm 6.

Represented in FIG. 4 is a first compaction position, in which the first compaction lid 3 is situated in the first retreated position, the first arm 5 of the second compaction lid 4 is situated in the second advanced position and the second arm 6 is situated in the extended position. Advantageously, when the first arm 5 is moved towards the second advanced position, it is possible to carry out a first compaction of the mass of material, by compacting it towards the lateral face 13 of the abutment surface 20 of the support structure 2 and towards the first compaction surface 30 of the first compaction lid 3.

Represented in FIG. 5 is a second compaction position, in which the first compaction lid 3 is situated in the first retreated position, the first arm 5 of the second compaction lid 4 is situated in the second advanced position and the second arm 6 is situated in the collected position. Advantageously, when the first arm 5 is situated in the second advanced position and the second arm 6 is moved towards the collected position, it is possible to carry out a second compaction of the mass of material, compacting towards the base face 12 of the abutment surface 20 of the support structure 2.

In addition, when the second arm 6 is moved from the extended position to the collected position, it is possible to carry out a redistribution of the mass of material already partially compacted within the pressing chamber 200 in order to obtain a mass of waste compacted in a uniform manner.

Figure 6:
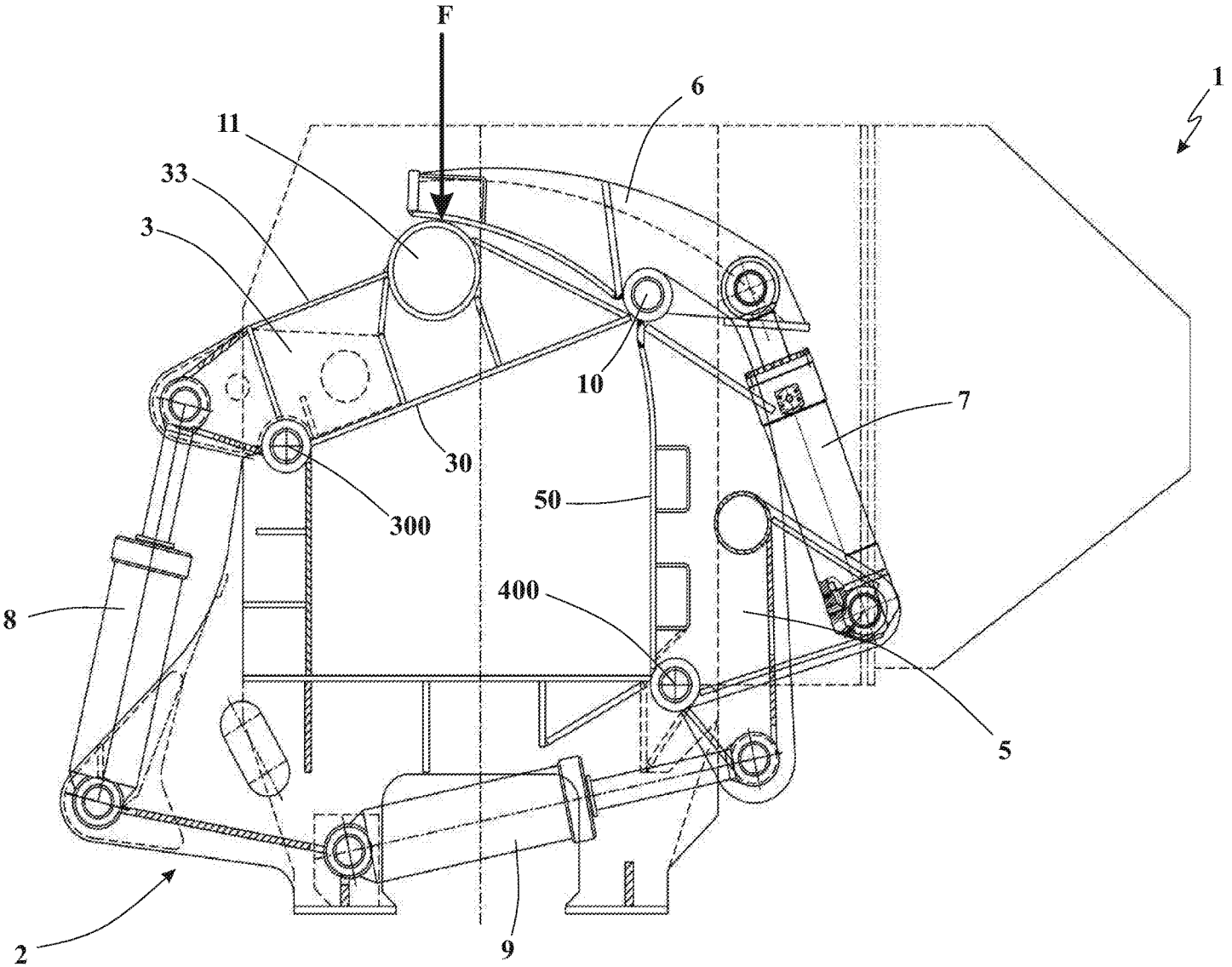

Represented in FIG. 6 is an abutment position, in which the first compaction lid 3 is situated in an intermediate position between the first retreated position and the first advanced position, the first arm 5 of the second compaction lid 4 is situated in the second advanced position and the second arm 6 is situated in abutment against the first compaction lid 3 by thrustingly acting against the latter in order to facilitate the advancement of the first compaction lid 3 towards the first advanced position.

Such abutment position is reached, for example, starting from the second compaction position illustrated in FIG. 5, by moving the second arm 6 of the second compaction lid 4 from the collected position to the extended position, and then moving the first compaction lid 3 from the first retreated position towards the first advanced position, and moving the second arm 6 from the extended position towards the collected position until abutting against the first compaction lid 3.

In operation, the second arm 6 of the second compaction lid 4 can be moved in order to abut against the first compaction lid 3, and more in detail to abut against the external surface 33 of the second compaction lid 3. In this manner, the second arm 6 of the second compaction lid 4 actively cooperates with the first compaction lid 3 in the final part of the crushing action that the latter exerts on the mass of material to be compacted.

Advantageously, the joint movement of the first compaction lid 3 and of the second arm 6 of the second compaction lid 4 allows compacting a considerable amount of material that was already partially compacted by the first arm 5 of the second compaction lid 4 and accumulated in front of the first compaction lid 3.

Advantageously, the first compaction lid 3 is provided with at least one abutment element 11 placed at the external surface 33 and preferably placed closer to the first external edge 31 than the first internal edge 32 of the first compaction lid 3 itself.

Such abutment element 11 is adapted to abuttingly receive the second section 60 of the second compaction surface 40 defined by the second arm 6 of the second compaction lid 4 with the compaction lids 3, 4 in closed position.

Advantageously, the abutment element 11 is provided with at least one curved portion against which the second section 60 of the second compaction surface 40 abuts with the compaction lids 3, 4 in closed position.

More in detail, the abutment element 11 comprises at least one cylindrical element extended parallel to the first longitudinal axis X and preferably comprises a single cylindrical element extended along the entire longitudinal extension of the first compaction lid 3, or comprises multiple cylindrical elements that are equidistant along the longitudinal extension of the first compaction lid 3.

In operation, as illustrated in the examples of FIGS. 2 and 6, the second section 60 of the second compaction surface 40 only contacts the abutment element 11 when the second arm 6 of the second compaction lid 4 is moved to abut against the first compaction lid 3. In this manner, it is possible to constrain the point of application of the force F that the second arm 6 exerts on the first compaction lid 3 to the curved portion of the abutment element 11.

Advantageously, the abutment element 11 confers greater solidity to the first compaction lid 3. Indeed, by constraining the point of application of the force G to the abutment element 11, also the arm of the moment generated by the force F is constrained, and hence the intensity of the force F itself is constrained.

More in detail, according to the present finding, the first compaction lid 3, during the movement from the first retreated position to the first advanced position compressing the mass of material, is subjected to a constant moment. Indeed, since the moment applied to the first compaction lid 3 corresponds to the vector product of the force F and the distance between the application point of the force F and the second hinge 300 (arm of the moment), if this distance is constrained by the abutment element 11, i.e. it is constant, also the value of the force F to be imparted is constrained and constant.

If instead, different from the present finding, the first compaction lid 3 did not include the abutment element 11, the abutment point of the second section 60 of the second compaction surface 40 would slide along the external surface 33 of the first compaction lid 3 during the joint movement of the second arm 6 and the first compaction lid 3. Consequently, the application point of the force F would be progressively moved from the first external edge 31 towards the second hinge 300, progressively reducing the arm of the moment exerted and hence requiring an increasingly higher force F in order to lower the first compaction lid 3, thus bringing the second hinge 300 to sustain very high forces that could involve a damaging thereof.

Figure 8:
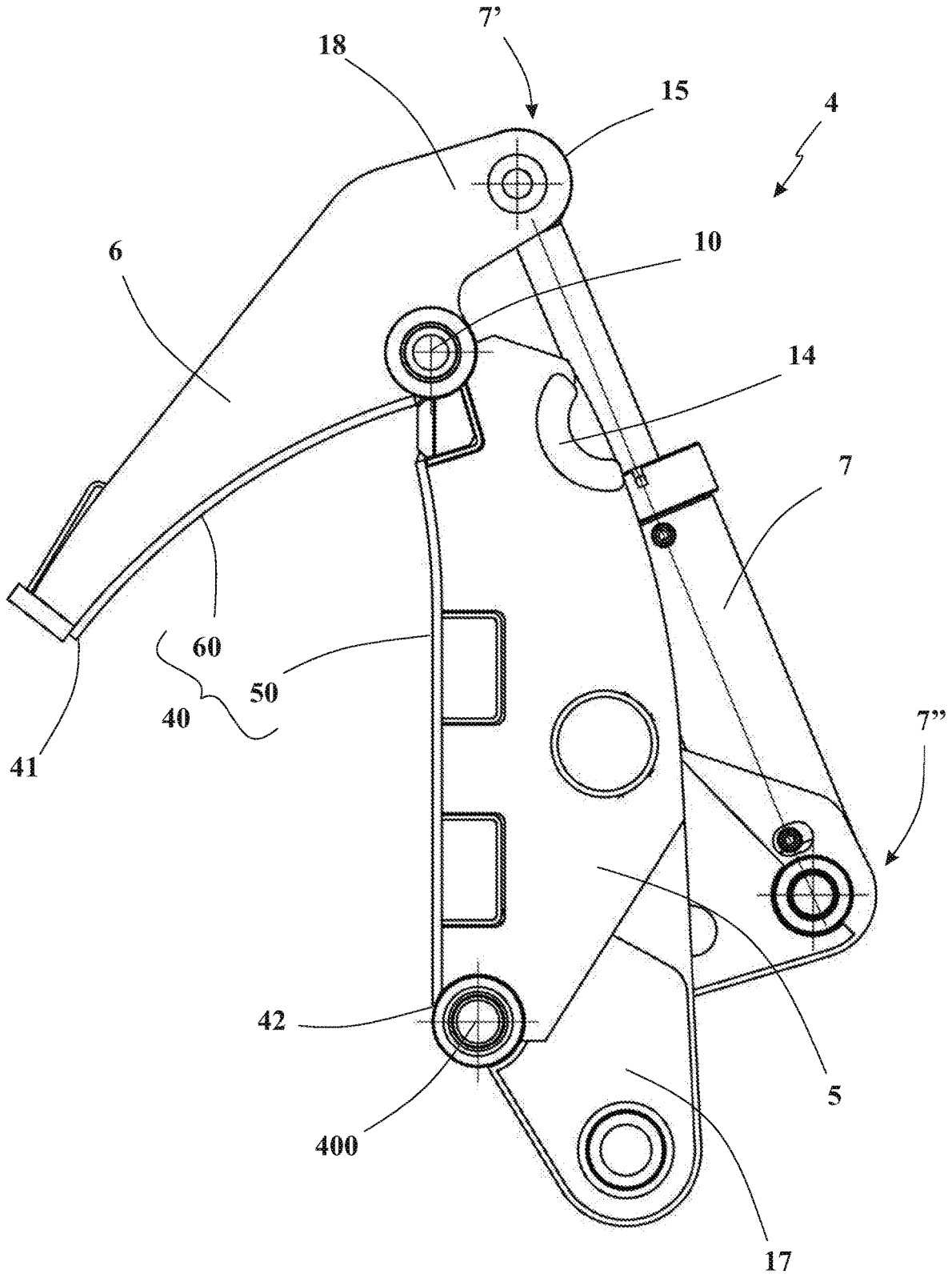
FIG. 8 shows a side view of a detail of the present compaction press, relative to a second compaction lid.

In accordance with a preferred embodiment of the present finding, as indicated in the example of FIG. 8, the first arm 5 comprises at least one first end stop portion 14 and the second arm 6 comprises at least one second end stop portion 15 which, with the second arm 6 in extended position, is abutted against the first end stop portion 14.

Advantageously, the movement system 100 comprises multiple end stop sensors (not illustrated in the enclosed figures) configured for detecting end stop positions, in closing or in opening, of the first compaction lid 3, of the first arm 5 and of the second arm 6 of the second compaction lid 4.

In operation, the end stop sensors and the control unit 1000 of the movement system 100 are configured for preventing the first compaction lid 3 and the first and second arms 5, 6 of the second compaction lid 4 from being moved into positions that are damaging for the compaction press 1.

Figure 10:
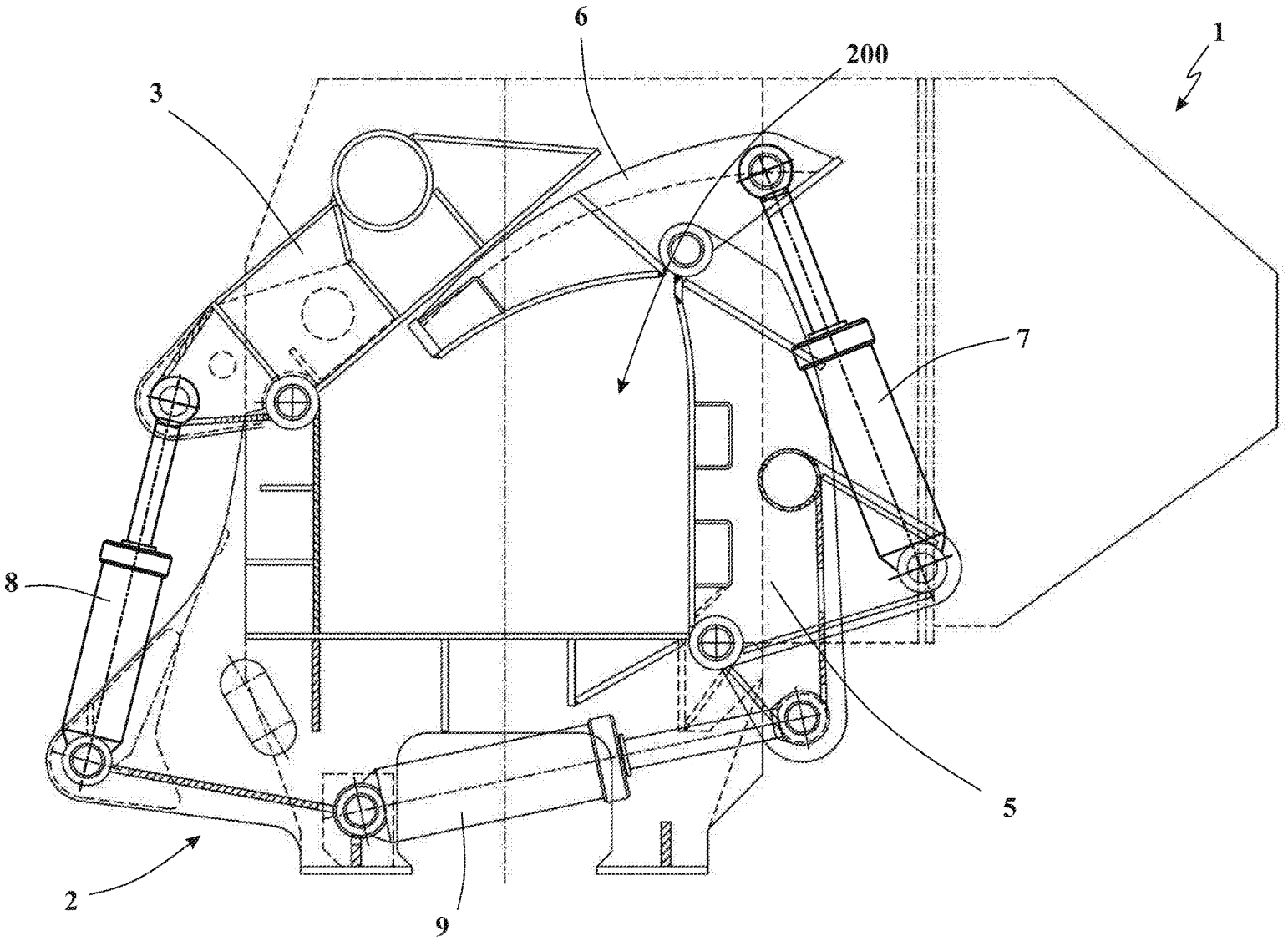
FIG. 10 shows a side view of the present compaction press of the present invention with the two compaction lids in a particular damaging operating position to be avoided.

More in detail, a damaging position for the compaction press 1 is the work position represented in the example of FIG. 10, in which the first compaction lid 3 is moved in order to abut against the second arm 6 of the second compaction lid 4.

In operation, the aforesaid work position is prevented by the control unit 1000 of the movement system 100, which is configured for actuating the first actuator 8 to move the first compaction lid 3 from the first open position to the first closed position usually when the end stop sensors detect that the second end stop position 15 of the second arm 6 is in abutment against the first end stop position 14 of the first arm 5.

Figure 7:
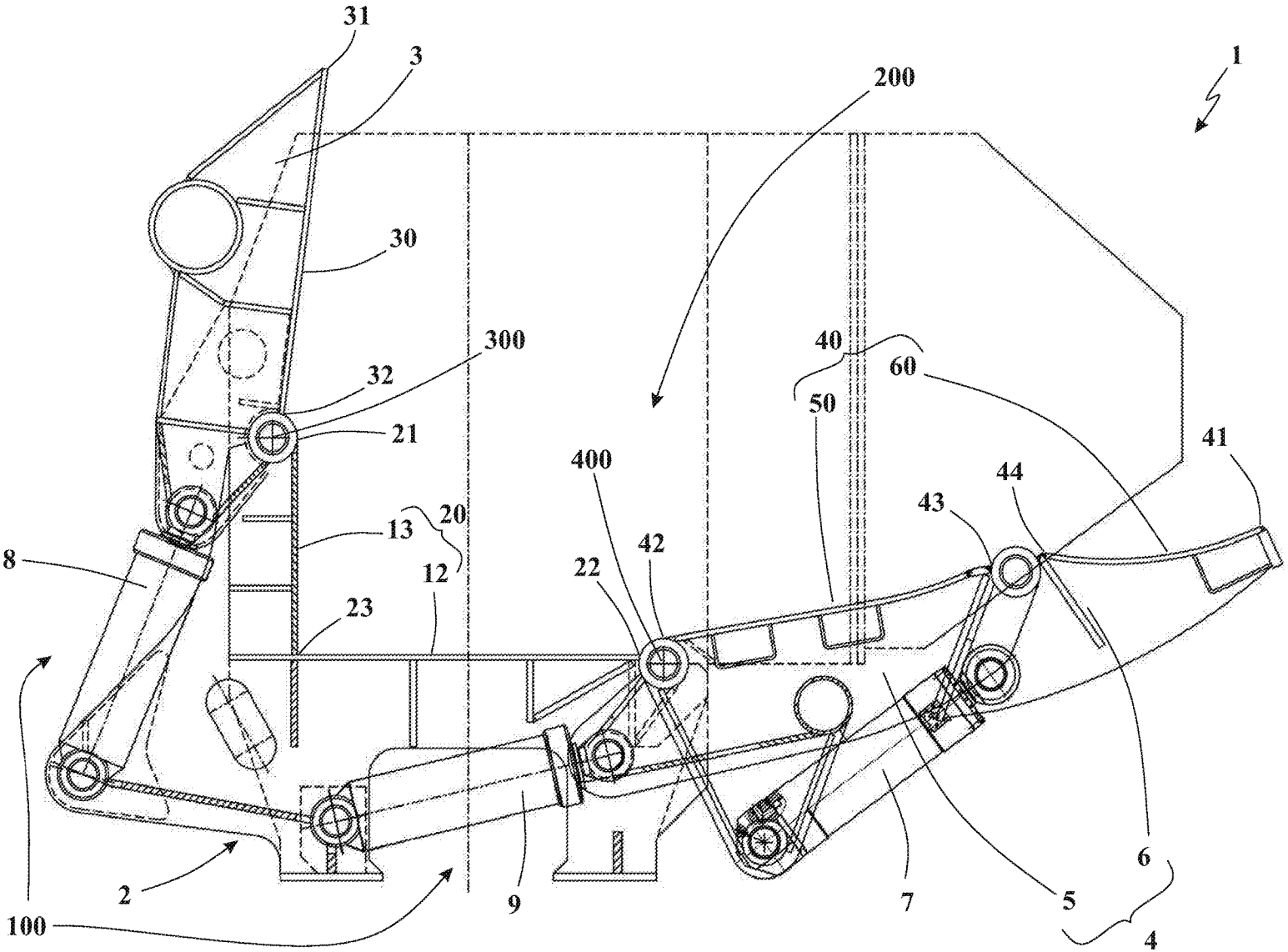
FIG. 7 shows a side view of the present compaction press with the two compaction lids in an augmented open position.

In accordance with a particular embodiment of the present finding, illustrated in the example of FIG. 7, the second compaction lid 4 can be configured so as to reach an augmented open position when the second arm 6 is in extended position.

Advantageously, in the aforesaid augmented open position, the second arm 6 of the second compaction lid 4 has executed an extra extension travel, in a manner such that the second external edge 41 of the second compaction surface 40 is situated at a lowered height than that of the open position illustrated in the example of FIG. 1. This allows advantageously facilitating the loading of the mass of material in the pressing chamber 200, requiring the lifting of such material to a lower height, also by means of a movement apparatus such as the fork lift of a forklift truck.

The invention claimed is:

1. A compaction press, comprising:

a support structure (2), provided with at least one abutment surface (20) extended between a first delimitation edge (21) and a second delimitation edge (22);

a first compaction lid (3), provided with a first compaction surface (30) extended between a first external edge (31) and a first internal edge (32), wherein, at said first internal edge (32), said first compaction lid (3) is rotatably constrained to said support structure (2) at said first delimitation edge (21);

a second compaction lid (4), provided with a second compaction surface (40) with concave profile and at least partially curved and extended between a second external edge (41) and a second internal edge (42), wherein, at said second internal edge (42), said second compaction lid (4) is rotatably constrained to said support structure (2) at said second delimitation edge (22); said abutment surface (20), said first compaction surface (30) and said second compaction surface (40) delimiting a pressing chamber (200) in which a mass of material to be compacted is intended to be arranged;

a movement system (100), which is mechanically connected to said first compaction lid (3) and to said second compaction lid (4), and is arranged for moving said first compaction lid (3) and said second compaction lid (4) at least between an open position, in which said pressing chamber (200) is open to allow a deposit of said mass of material, and a closed position, in which said pressing chamber (200) is closed by said first compaction lid (3) and by said second compaction lid (4) in order to compact said mass of material;

wherein said second compaction lid (4) comprises:

a first arm (5) defining a first section (50) of said second compaction surface (40), extended between said second internal edge (42) and a third internal edge (43);

a second arm (6) defining a second section (60) of said second compaction surface (40), extended between said second external edge (41) and a fourth internal edge (44), wherein, at said fourth internal edge (44), said second arm (6) is rotatably constrained to said first arm (5) at said third internal edge (43);

wherein said first compaction lid (3) is provided with at least one abutment element (11) placed at an external surface (33) of said first compaction lid (3), said external surface (33) being opposite said first compaction surface (30); said abutment element (11) abuttingly receiving the second section (60) of the second compaction surface (40) defined by the second arm (6) of said second compaction lid (4) with said first compaction lid (3) and said second compaction lid (4) placed at least in said closed position.

2. The compaction press of claim 1, wherein said movement system (100) comprises at least one movement actuator (7) mechanically connected to the second arm (6) of said second compaction lid (4) and is arranged for moving said second arm (6) with respect to said first arm (5).

3. The compaction press of claim 2, wherein said at least one movement actuator (7) is arranged for moving said second arm (6) at least between an extended position and a collected position in which the second section (60) of said second compaction surface (40) faces the first section (50) of said second compaction surface (40).

4. The compaction press of claim 2, wherein said at least one movement actuator (7) mounted on the first arm (5) of said second compaction lid (4) and connected to said second arm (6).

5. The compaction press of claim 4, wherein said movement actuator (7) is a linear actuator.

6. The compaction press of claim 5, wherein said movement system (100) further comprises:

at least one first actuator (8) connected to said first compaction lid (3) in order to move said first compaction lid (3);

at least one second actuator (9) connected to the first arm (5) of said second compaction lid (4) in order to move said first arm (5);

a control unit (1000), which is operatively connected to said movement actuator (7), to said first actuator (8) and to said second actuator (9), and is configured for independently actuating said movement actuator (7), said first actuator (8) and said second actuator (9).

7. The compaction press of claim 1, wherein said second compaction lid (4) is longitudinally extended along a first longitudinal axis (X) parallel to said second internal edge (42);

wherein the first arm (5) of said second compaction lid (4) is hinged to the second arm (6) of said second compaction lid (4) by means of at least one first hinge (10) having rotation axis parallel to said first longitudinal axis (X).

8. The compaction press of claim 1, wherein said abutment element (11) is provided with at least one curved portion, against which the second section (60) of said second compaction surface (40) is susceptible of abutting.

9. The compaction press of claim 7, wherein said abutment element (11) comprises at least one cylindrical element extended parallel to said first longitudinal axis (X).

10. The compaction press of claim 1, wherein said abutment element (11) is placed closer to said first external edge (31) than said first internal edge (32).

11. The compaction press of claim 1, wherein the second section (60) of said second compaction surface (40) is curved.

12. The compaction press of claim 1, wherein said first compaction surface (30) is flat.

13. The compaction press of claim 1, wherein the abutment surface (20) of said support structure (2) defines a housing concavity.

14. The compaction press of claim 13, wherein said abutment surface (20) comprises:

a base face (12), substantially horizontal, extended between said second delimitation edge (22) and a vertex edge (23);

a lateral face (13), substantially orthogonal to said base face (12) and extended between said first delimitation edge (21) and said vertex edge (23).

15. The compaction press of claim 1, wherein said first arm (5) comprises at least one first end stop portion (14); and wherein said second arm (6) comprises at least one second end stop portion (15) which, with said second arm (6) in extended position, is abutted against said first end stop portion (14).

* * * * *